US008917295B2

(12) United States Patent
Woo et al.

(10) Patent No.: US 8,917,295 B2
(45) Date of Patent: Dec. 23, 2014

(54) METHOD FOR DRIVING ORGANIC LIGHT EMITTING DISPLAY DEVICE WITH A GAMMA VOLTAGE GENERATOR

(75) Inventors: Kyoung Don Woo, Gyeonggi-do (KR); Eun Jeong Jin, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 239 days.

(21) Appl. No.: 13/444,403

(22) Filed: Apr. 11, 2012

(65) Prior Publication Data

US 2013/0083083 A1 Apr. 4, 2013

(30) Foreign Application Priority Data

Sep. 30, 2011 (KR) ..... 10-2011-0100311

(51) Int. Cl.
*G09G 5/10* (2006.01)
*G09G 3/32* (2006.01)

(52) U.S. Cl.
CPC ..... *G09G 3/3208* (2013.01); *G09G 2320/0276* (2013.01); *G09G 2330/028* (2013.01)
USPC ..... 345/690; 345/77

(58) Field of Classification Search
USPC ..... 345/690, 77
See application file for complete search history.

(56) References Cited

U.S. PATENT DOCUMENTS

2002/0158882 A1* 10/2002 Liaw et al. ..... 345/589
2005/0212786 A1* 9/2005 Nitta et al. ..... 345/204
2009/0201275 A1* 8/2009 Bae ..... 345/208
2010/0007680 A1* 1/2010 Yu et al. ..... 345/690
2010/0033514 A1* 2/2010 Park et al. ..... 345/690

FOREIGN PATENT DOCUMENTS

CN 100406967 C 7/2008
CN 101510392 A 8/2009
JP 2009-193042 A2 8/2009
KR 10-2008-0037555 A 4/2008

OTHER PUBLICATIONS

Korean Intellectual Property Office, Office Action, Korean Patent Application No. 10-2011-0100311, Feb. 27, 2014, four pages [with concise explanation of relevancy in English].

State Intellectual Property Office of the People's Republic of China, First Office Action, Chinese Patent Application No. 201210361447.2, Jul. 2, 2014, ten pages.

* cited by examiner

*Primary Examiner* — Kwang-Su Yang
(74) *Attorney, Agent, or Firm* — Fenwick & West LLP

(57) ABSTRACT

A display device, such as a OLED device, and a method of driving the OLED device. The display device includes a gamma voltage generator that generates sequentially decreasing gamma voltages based on sequentially decreasing reference voltages. A data driver selects a gamma voltage from the gamma voltages for driving a pixel based on digital data indicative of a gray scale level for the pixel. In one embodiment the gamma voltage generator includes a resistor string and an input tab that is electrically isolated from the resistor string.

4 Claims, 8 Drawing Sheets

| VDD | Frame Rate | SECOND RELATED ART | PRESENT EMBODIMENT | IMPROVED RESULTANT |
|---|---|---|---|---|
| 13.5V | 60Hz | 83.3 | 62.9 | -19.4(23%) |
| | 120Hz | 92.0 | 71.6 | -20.4(22%) |

METHOD FOR DRIVING ORGANIC LIGHT EMITTING DISPLAY DEVICE WITH A GAMMA VOLTAGE GENERATOR

CROSS-REFERENCE TO RELATED APPLICATION

This application claims priority under 35 U.S.C. 119 to Korean Patent Application No. 10-2011-0100311, filed on Sep. 30, 2011, which is hereby incorporated by reference in its entirety.

BACKGROUND

1. Field of the Disclosure

This disclosure relates to an organic light emitting display (OLED) device.

2. Description of the Related Art

OLED devices use an organic light emission layer that emits light through the recombination of electrons with electrical holes. Such OLED devices corresponding to a self-luminous display device are considered to be next generation display devices due to their high brightness, low drive voltage and possible slimness.

An OLED device includes a plurality of pixel elements. Each of the pixel elements includes a pixel configured with an organic light emission layer between an anode and a cathode, and a pixel circuit configured to drive the pixel. The pixel circuit is configured to include a switching transistor, a capacitor and a driving transistor. The switching transistor receives a scan pulse and charges a data voltage into the capacitor. The driving transistor controls an amount of electrical current to be applied to the pixel based on the data voltage charged in the capacitor, thereby adjusting a gray level of the pixel.

A data driver included in a driver circuit of the OLED device subdivides a plurality of reference voltages from an external gamma voltage generator into gray scale gamma voltages. Also, the data driver converts digital data into an analog data signal (more specifically, a voltage signal or a current signal) using the gray scale gamma voltages. The OLED device adjusts the brightness of the OLED device by adjusting the most significant reference voltage based on a brightness control command from a user.

FIG. 1 is a data sheet illustrating the characteristics of gamma voltages conventionally used for driving OLED devices.

Referring to FIG. 1, the conventional gamma voltage generator (e.g., within the data driver) is configured with a plurality of input gamma tabs (for example, zeroth through ninth gamma tabs) with serially connected resistors between each tab. The ninth gamma tab receives the highest reference voltage on the basis of a power supply voltage VDD. The zeroth gamma tab receives the lowest reference voltage on the basis of a ground voltage VSS. The reference voltages received by the input gamma tabs decrease in order from the ninth gamma tab to the zeroth gamma tab. The gamma voltage generator also has output gamma tabs. The output gamma tabs output gamma voltages that decrease in voltage from the highest order (e.g. $255^{th}$) to the lowest order (e.g. $0^{th}$) tab. The output gamma voltages also correspond to gray scale levels 255 through 0.

In the first related art "-●-", the reference voltages are sequentially lowered as the orders of the gamma tabs are lowered (the ninth gamma tab is the highest order tab, the zeroth gamma tab is the lowest order tab). The lowest gamma voltage is used for deriving a lowest gray scale data signal with a lowest voltage, in order to realize black brightness. Also, the highest gamma voltage is used for deriving a highest gray scale data signal with a highest voltage, in order to realize white brightness. In other words, the gamma voltage is used to drive the pixel to black brightness.

The first related art "-●-" has a gamma characteristic as a normal gamma curve of 2.2 shown in FIG. 1. To this end, the first related art raises the reference gamma voltages by a fixed level according to a sequence progressing from the zeroth gamma tab to the ninth gamma tab. The first related art also raises the voltages of the gray scale data signals in the same manner as the reference gamma voltages.

As such, in the first related art, the lowest gamma voltage is used for realizing black brightness, and the highest gamma voltage is used for realizing white brightness. In other words, the lowest gamma voltage corresponds to a gray scale level of "0" (black brightness), and the highest gamma voltage corresponds to a gray scale level of "255" (white brightness).

Particularly, the first related art physically separates zeroth and first gamma output tabs, which output the gamma voltages opposite to the gray scales of "0"and "1". Separating the zeroth and first gamma output tabs from each allows the gamma voltage output by the zeroth tab to have a voltage level that corresponds to substantial black brightness.

The second related art "-■-" also provides the same gamma voltages as the first related art. However, the second related art enables not only the lowest gamma voltage to be used for deriving a lowest gray scale data signal with the highest voltage, but also the highest gamma voltage to be used for deriving a highest gray scale data signal with the lowest voltage, unlike the first related art.

In other words, the second related art "-■-" allows the voltages of the gray scale data signal to be in inverse proportion to the gamma voltages being output from gamma output tabs. This is due to the first related art being configured to drive a NMOS pixel, and the second related art being configured to drive a PMOS pixel.

As such, in the second related art, as the order of the gamma output tab becomes higher, the value of the gray scale is lowered from "255"to "0". More specifically, the lowest gamma voltage generated at the most significant gamma output tab (e.g. the $255^{th}$ output tab) corresponds to the lowest gray scale data signal which has the highest voltage and is used for realizing black brightness. Also, the highest gamma voltage generated at the least significant gamma output tab (e.g. the zeroth output tab) corresponds to the highest gray scale data signal which has the lowest voltage and is used for realizing white brightness.

However, the second related art reversely matching the gamma voltages to the gray scale data signals causes the deterioration of brightness in a low gray scale domain, unlike the first related art.

FIG. 2 is a data sheet illustrating brightness characteristics of OLED devices according to the related arts. FIG. 3 is a data sheet illustrating the characteristics of data voltages of OLED devices according to the second related art.

Referring to FIG. 2, when the OLED device of the first related art is driven, black brightness rises steeply between the gray scales of "0" and "1" and then rises slowly from the gray scale of "1" to the gray scale of "31". This results from the fact that the zeroth and first gamma input tabs (and also the zeroth and first gamma output tabs) are physically separated from each other in order to realize black brightness.

On the other hand, referring to FIGS. 2 and 3, black brightness provided by the OLED device of the second related art, which uses the gamma voltages that are inverted from those in the first related art, is linearly varied from the gray scale of "0"

to the gray scale of "31" without the steep increase between the gray scales of "0" and "1". This is because the ninth and eighth input gamma tabs are connected to each other through resistors.

Due to this, the OLED device of the second related art provides lower brightness in a gray scale range of 1-31, compared to that of the first related art, as shown in FIG. 2.

Also, although it is not shown in the drawings, the second related art includes resistors connected between the ninth and eighth gamma input tabs. In other words, the ninth and eighth gamma input tabs in the second related art are not separated from each other. As such, the high data voltages corresponding to the gray scales of 0 through 31 increase the quantity of current.

Because the eighth and ninth tabs are not separated, the current increment in the ninth and eighth gamma tabs causes high power consumption. Due to this, a large quantity of heat is generated in the gamma voltage generator, and reduces the life span of the components in the gamma voltage generator.

BRIEF SUMMARY

Embodiments relate to a display device and method of operating the display device. The display device comprises a gamma voltage generator configured to receive a plurality of sequentially decreasing reference voltages. The gamma voltage generator also generates a plurality of sequentially decreasing gamma voltages based on the sequentially decreasing reference voltages. The display device also comprises a data driver coupled to the gamma voltage generator and configured to receive the plurality of sequentially decreasing gamma voltages from the gamma voltage generator. The data driver outputs, to a pixel, a first gamma voltage selected from the plurality of gamma voltages responsive to receiving first digital data indicative of a first gray scale level of the pixel. The data driver also outputs, to the pixel, output, to the pixel, a second gamma voltage from the plurality of gamma voltages responsive to receiving second digital data having a higher digital value than the first digital data and indicative of a second gray scale level higher than the first gray scale level. The second gamma voltage is lower than the first gamma voltage.

In one embodiment the gamma voltage generator includes a resistor string configured to generate at least some of the gamma voltages (e.g. 1-255) based on at least some of the reference voltages. The gamma voltage generator also includes a zeroth input tab configured to receive a highest reference voltage of the reference voltages. The zeroth input tab is electrically isolated from the resistor string. A highest gamma voltage of the gamma voltages is generated from the highest reference voltage.

Advantages of the disclosed embodiments include, for example, preventing the deterioration of brightness in a low gray scale range and reducing heat generation of a gamma voltage generator by applying reversely lowered reference voltages to zeroth through ninth gamma tabs serially arranged within the gamma voltage generator and setting data voltages in proportion to gamma voltages from gamma output tabs with the gamma voltage generator.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION

Figure 1:
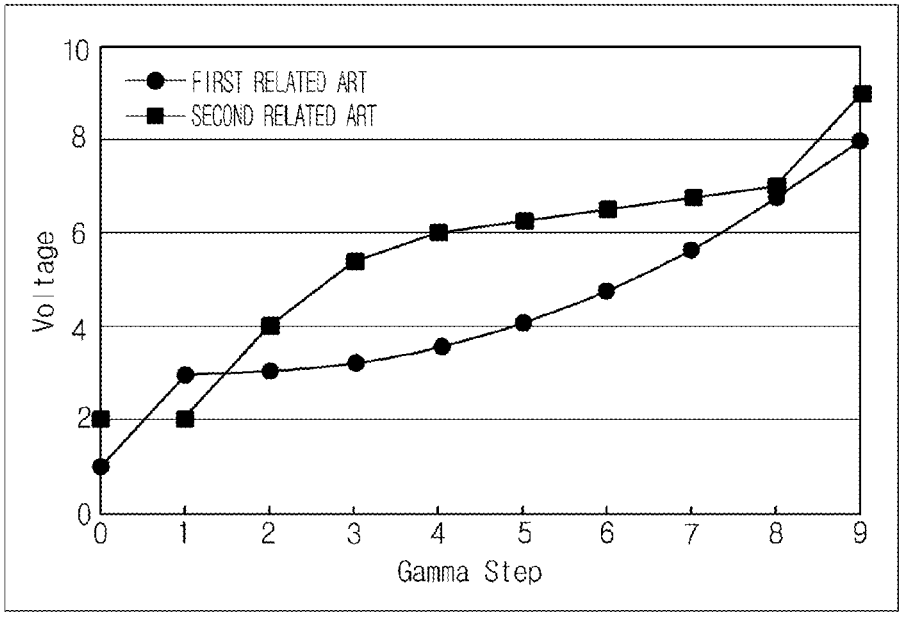
FIG. 1 (prior art)
FIG. 1 is a data sheet illustrating the characteristics of gamma voltages conventionally used for driving OLED devices.
Figure 2:
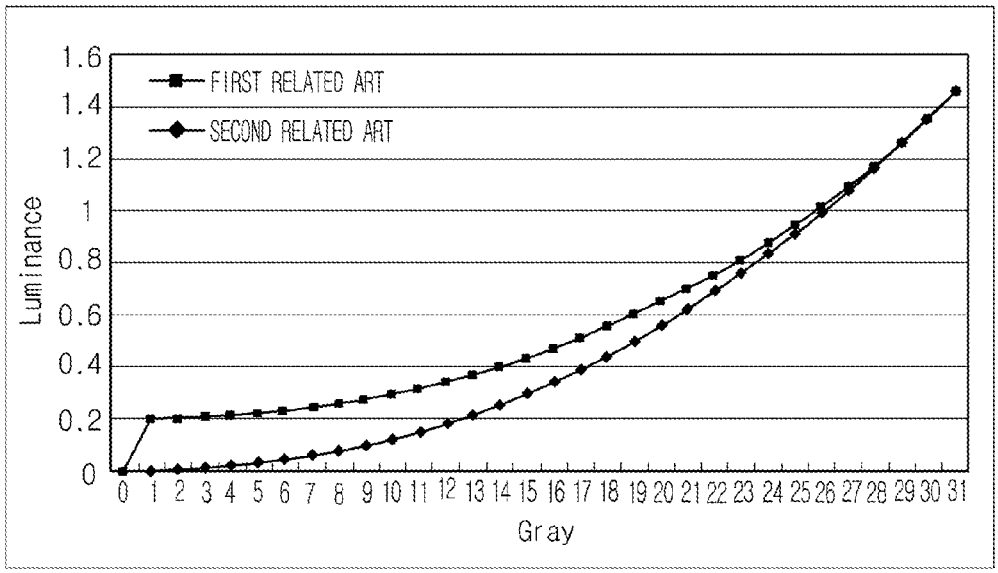
FIG. 2 (prior art)
FIG. 2 is a data sheet illustrating brightness characteristics of conventional OLED devices.
Figure 3:
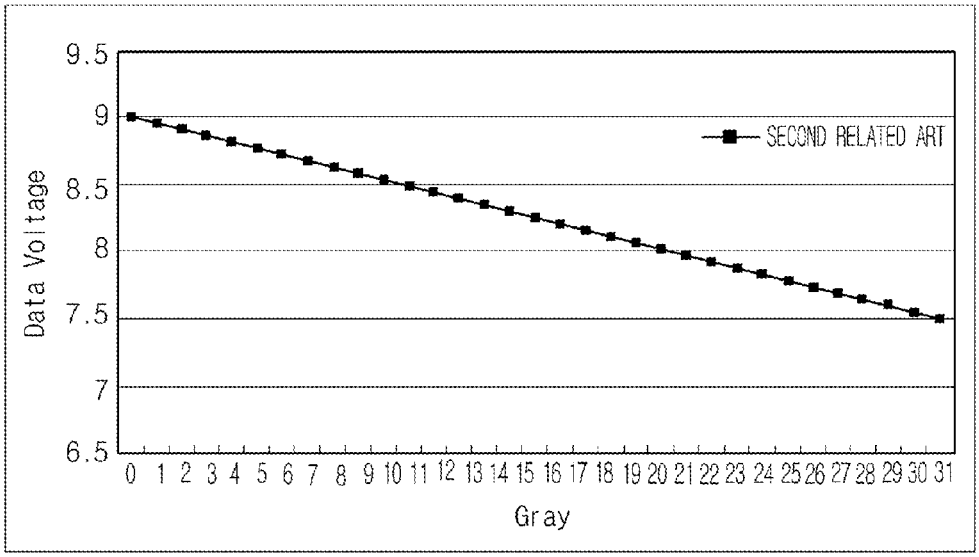
FIG. 3 (prior art)
FIG. 3 is a data sheet illustrating the characteristics of data voltages of conventional OLED devices.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. In the drawings, the size, thickness and so on of a device can be exaggerated for convenience of explanation. Wherever possible, the same reference numbers will be used throughout this disclosure including the drawings to refer to the same or like parts.

Figure 4:
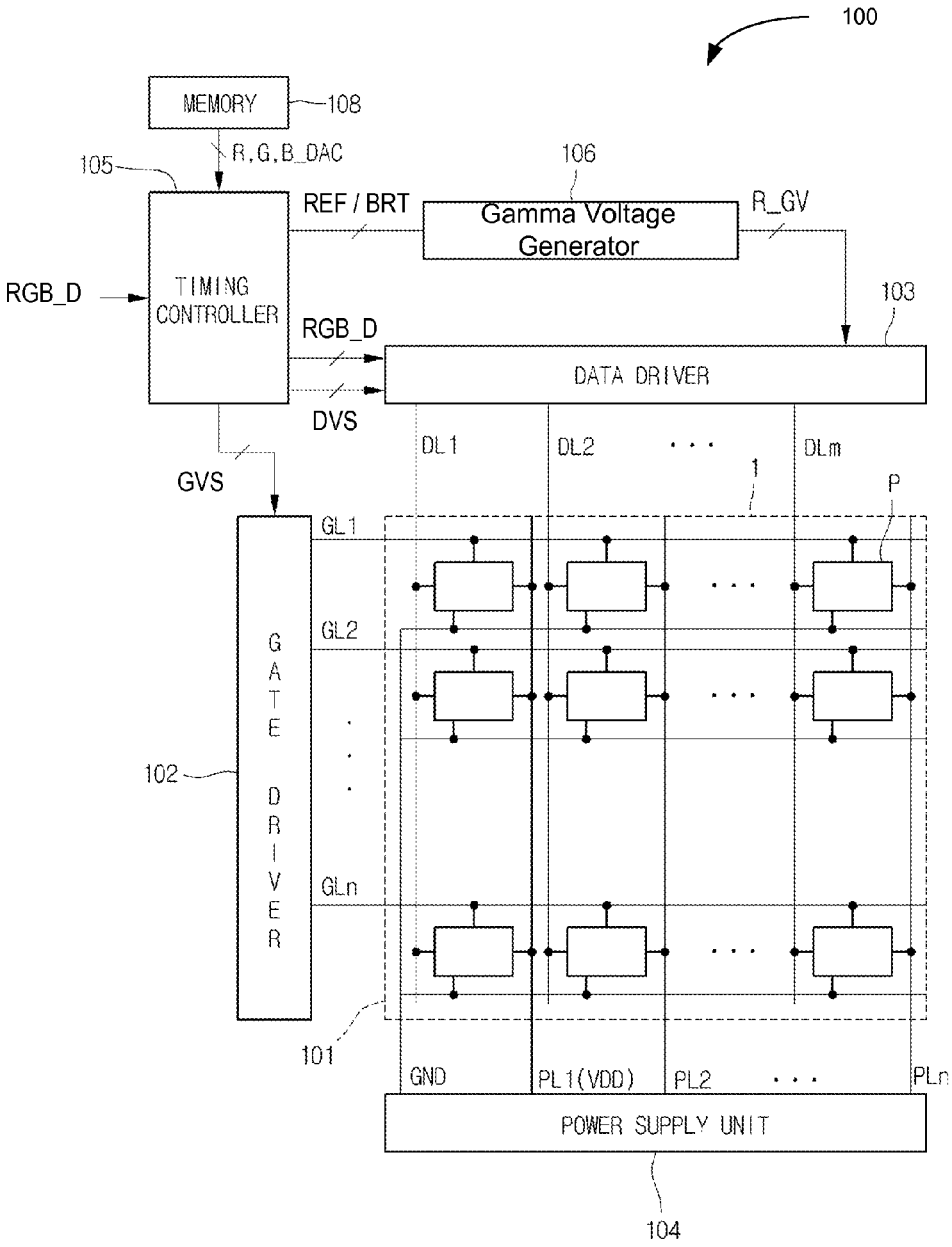
FIG. 4 is a block diagram showing the configuration of an OLED device according to an embodiment of the present disclosure.
Figure 5:
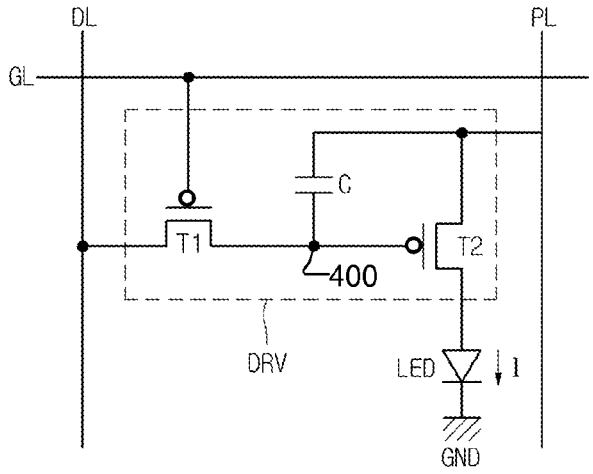
FIG. 5 is a circuit diagram showing each of the sub-pixels on the OLED panel in FIG. 4.

FIG. 4 is a block diagram showing the configuration of an OLED device 100 according to an embodiment of the present disclosure. FIG. 5 is a circuit diagram showing each of the sub-pixels on the OLED panel 100 in FIG. 4.

As shown in FIG. 4, the OLED device according to an embodiment of the present disclosure can include, among other components: a display panel 101 defined into a plurality of pixel regions P; a gate driver 102 configured to drive gate lines GL1 through GLn on the display panel 101; a data driver 103 configured to drive data lines DL1 through DLm on the display panel 101; and a power supply unit 104 configured to apply first and second power signals VDD and GND to power lines PL1 through PLn on the display panel 101.

A timing controller 105 receives externally input red, green and blue data RGB_D. The timing controller 105 then provides the data RGB_D configured to apply externally input red, green and blue (hereinafter, "R, G and B") data to the data driver 103. Red, green, and blue are hereinafter referred to as R, G, and B. The timing controller 105 also outputs R, G, and B reference voltages REF to the gamma voltage generator 106 which are used in the generation of gamma voltages for each of the R, G and B colors. A gamma voltage generator 106 is configured to derive R, G and B gamma voltage sets R_GV using the reference voltages REF input from the timing controller 105 and to output the generated R, G and B gamma voltage sets R_GV to the data driver 103.

In one embodiment, the gamma voltage generator 106 includes R, G and B gamma voltage generation portions. Each of the R, G and B gamma voltage generation portions receives different reference voltages REF from the timing controller 105. Moreover, each of the gamma voltage generation portions applies the highest reference voltage to a zeroth gamma input tab and the lowest reference voltage to a ninth gamma tab, unlike the related art. More specifically, the reference voltages applied to the input gamma tabs decrease in voltage level (e.g., from 10V to 0V) as the order of the input gamma tabs increase. As such, each of the gamma voltage generation portions also outputs gamma voltages R_GV that decrease in voltage level (e.g., from 10V to 0V) as the order of the output gamma tabs increases. The gamma voltage generator 106 thus outputs gamma voltages R_GV that are reversed with respect to those of the conventional art.

Furthermore, the embodiment matches not only a high gamma voltage among the gamma voltages provided by the gamma voltage generator 106 to a low gray scale value data, but also a low gamma voltage to a high gray scale value data. As such, low gray scale data signals can have high level voltages, and high gray scale data signals can have low level voltages. Therefore, a black output level (low brightness) from the pixels P can be realized by the high voltage data signal derived from the high gamma voltage, while white output level (high brightness) can be realized by the low voltage data signal derived from the low gamma voltage.

The timing controller 105 can output a brightness coefficient BRT in each of R, G and B colors to the gamma voltage generator 106. Also, the timing controller 105 can re-arrange the externally input R, G and B data RGB_D into a format suitable for the size and definition of the display panel 101, and apply the re-arranged R, G and B data RGB_D to the data driver 103. Moreover, the timing controller 105 can generate data control signals DVS, to be applied to the data driver 103, and gate control signals GVS to be applied to the gate driver 102.

The display panel 101 can include a plurality of sub-pixels P which are arranged in a matrix shape and are used in the display of an image. The sub-pixels P are disposed in the pixel regions, respectively. Each of the sub-pixels P can include a light emission cell and a cell driver configured to drive the light emission cell. In detail, referring to FIG. 5, a single sub-pixel P can include: a cell driver DRV which is connected between a gate line GL, a data line DL and a power line PL, and a light emission diode LED connected between the cell driver DRV and a second power line GND and equivalently shown as a diode symbol.

The cell driver DRV can include: a first switch element T1 connected to the gate line GL and the data line DL; a second switch element T2 connected between the first switch element T1, the power line PL and the light emission diode LED; and a storage capacitor C connected between the power line PL and a connection node of the first and second switch elements T1 and T2.

The first switch element T1 includes a gate electrode connected to the gate line GL, a source electrode connected to the data line DL, and a drain electrode connected to a gate electrode of the second switch element T2. Such a first switch element T1 can be turned-on (or activated) and can transfer a data signal on the data line DL to the storage capacitor C and the gate electrode of the second switch element T2, when a gate-on-signal is applied to the gate line GL.

The second switch element T2 includes a source electrode connected to the power line PL, and a drain electrode connected to the light emission diode LED. This second switch element T2 receives the data signal via the first switch element T1 and can control a current applied from the power line PL to the light emission diode LED, in order to control the amount of light emitted by the LED.

The storage capacitor C is connected between the power line PL and a connection node 400 which is connected to the drain electrode of the first switch element T1 and the gate electrode of the second switch element T2. The storage capacitor C is used for enabling the second switch element T2 to maintain the turning-on state using its charged voltage, even though the first switch element T1 is turned-off. In accordance therewith, a light emitting state of the light emission diode LED can be continuously maintained until the data signal of the next frame is applied to the data line DL.

Although PMOS transistors are used as first and second switch elements in the present embodiment, NMOS transistors instead of the PMOS transistors can be used as first and second switch elements. Also, a pulse width of the gate-on signal can be adjusted on the basis of a gate output enable signal. The gate line GL1 through GLn can receive the gate-on signals being sequentially applied from the gate driver 102. On the other hand, gate-off signals are applied to the gate lines GL to which the gate-on signal is not applied.

The data driver 103 receives data control signals DVS that include signals such as a source start pulse SSP and a source shift clock SSC. The data driver uses these signals DVS to convert one line of R, G and B data RGB_D from the timing controller 105 into analog voltages (i.e., analog image signals). The R, G and B data RGB_D may include, for example, 24-bits of digital data for each pixel. Each color is associated with 8 bits of the digital data. For each color, the data RGB_D for that color is indicative of the intended gray scale setting (i.e. intensity level) of that color in a given pixel.

The data driver 103 converts the R, G and B data RGB_D into the analog image signals using the reference gamma voltage sets R_GV. Each gamma voltage set R_GV includes the gamma voltages corresponding to the number of the gray scale values (or levels) capable of being displayed by each of the R, G and B data. For example, if R can take on 256 different gray scale levels, then the R gamma voltage set R_GV includes 256 different gamma voltages.

Also, the data control signals DVS can include a source output enable signal SOE. The data driver 103 uses this signal to apply one line of R, G and B analog image signals to the data lines DL1 through DLm on the display panel 101. More specifically, the data driver 103 latches one line of R, G and B data RGB_D which are synchronously input with the source shift clock SSC, and applies one horizontal line of the analog image signals to the data lines DL1 through DLm, for every horizontal period which the gate-on signal (or a scan pulse) is applied to any one of the gate line GL1 through GLn.

The gamma voltage generator 106 adjusts reference voltages REF in response to the brightness coefficients BRT for R, G and B colors, derives the R, G and B gamma voltage sets R_GV from the adjusted reference voltages, and provides the R, G and B gamma voltage sets R_GV to the data driver 103. The gamma voltage generator 106 can include a resistor string 602 for each of the R, G and B colors. One such resistor string 602 will be described in conjunction with FIG. 6.

The resistor string for the R color can voltage-divide the R reference voltages for the R color applied from the timing controller 105, can generate the R gamma voltage set including a plurality of R gamma voltages, and can apply the R gamma voltage set to the data driver 103. Similarly, the G and B resistor strings can voltage-divide the G and B reference voltage sets applied from the timing controller 105, respectively, in order to generate the G and B gamma voltage sets to be applied to the data driver 103.

The present embodiment allows each of the R, G and B resistor strings of the gamma voltage generator 106 to generate the gamma voltages each opposite to 0~255 gray scale values (or levels). For example, the R resistor string divides its resistors into resistor groups corresponding to the number of bits of the R data and each including resistors corresponding to the weight of each bit of the R data, and arranges the divided resistor groups between zeroth through ninth gamma tabs which receive the reference voltage different from one another applied from the timing controller 105. In other words, the R resistor string allots the 0~255 gray scale values for each of the zeroth through ninth gamma tabs in a weight value of each bit of the R data. As such, the R resistor string can derive the R gamma voltages opposite to the respective gray scale values by voltage-dividing the reference voltages applied to the zeroth through ninth gamma tabs.

Figure 6:
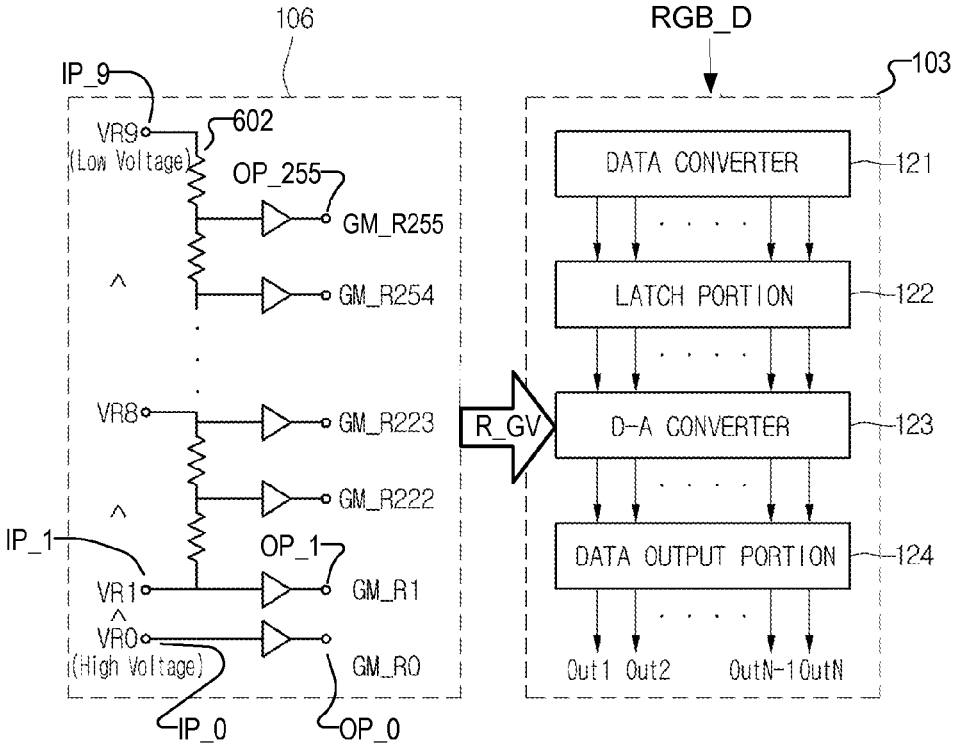
FIG. 6 is a detailed diagram showing the gamma voltage generator and the data driver included in the OLED device according to the embodiment of the disclosure.

Particularly, each of the R, G and B resistor strings within the gamma voltage generator 106 is configured in such a manner that the zeroth gamma tab is physically (or electrically) separated from the first through ninth gamma tabs as shown in FIG. 6, in order to realize substantial black brightness.

The present embodiment enables not only the highest reference voltage to be applied to the zeroth gamma tab, but also the reference voltages gradually lowered from the highest reference voltage to be applied to the first through ninth gamma tabs in a sequence progressing from the first gamma tab to the ninth gamma tab. This will be described in detail in FIG. 6.

FIG. 6 is a detailed diagram showing the gamma voltage generator 106 and the data driver 103 included in the OLED device according to the embodiment of the disclosure. Although the gamma voltage generator 106 is shown in the drawings in such a manner as to be separated from the data driver 103, in some embodiments, the gamma voltage generator 106 and data driver 103 may be part of the same integrated circuit.

The gamma voltage generator 106 can include three resistor strings 602 (only one resistor string 602 is shown in FIG. 6). One resistor string 602 is for the color R, another is for the color G, and another is for the color B. Each of the three resistor strings 602 can include a plurality of serially connected resistors.

Each resistor string 602 is coupled to a plurality of input gamma tabs (IP_1 through IP_9) and output gamma tabs (OP_1 to OP_255). Input gamma tab IP_0 and output gamma tab OP_R0 are not coupled to the resistor string 602. Note that not all of the tabs are labeled in FIG. 6. As used herein, a tab refers to an internal or external connection of a device through which signals can be transferred. If the tabs are external tabs, they may be attached to a printed circuit board (PCB) using a process such as tape-automated bonding (TAB) or wire bonding.

The input tabs IP receive ten different input voltages VR0-VR9. The input voltages VR may be brightness adjusted versions of the reference voltages REF. Alternatively, the input voltage VR may be the reference voltages REF received from the timing controller 105. The resistor strings 602 for each color may use different input voltages VR from the other resistor strings 602. The input voltages VR may also in a voltage range between a power supply voltage and a ground voltage.

Each of the input voltages VR has a different voltage level. The input voltages VR decrease sequentially in voltage as the order of the input gamma tabs IP increases (i.e. from IP_0 to IP_9). Input voltage VR0 at the zeroth gamma input tab IP_0 has the highest input voltage. Input voltage VR9 at the ninth gamma input tab IP_9 has the lowest input voltage. Other input voltages VR will have voltage levels that are between the highest voltage level and the lowest voltage level. The difference in voltage between each input voltage VR may or may not be the same.

For each color, the resistor string 602 voltage-divides the input voltages VR1_VR9 to generate a plurality of gamma voltages GM_R1-GM_R255. The zeroth gamma voltage GM_R0 is generated directly from the zeroth input voltage VR0 and may have substantially the same voltage level as the zeroth input voltage VR0.

As mentioned, the input voltages VR decrease in voltage level as the order of the input gamma tabs IP increases. Similarly, the gamma voltages GM_R also decrease in voltage level as the order of the gamma output tabs OP increases (e.g. from OP_0 to OP_255). For example, gamma voltage GM_R0 at output tab OP_0 has the highest voltage and gamma voltage GM_R255 at output tab OP_0 has the lowest voltage.

The gamma voltages GM_R are output via the output gamma tabs OP. The gamma voltages GM_R generated at gamma output tabs OP correspond to zeroth through $255^{th}$ gray scale values, respectively. The gamma voltages GM_R form a gamma voltage set R_GV that is provided to a digital-to-analog (D-A) converter 123 of the data driver 103 and used to convert digital data RGB_D into analog data voltages.

Also, the present embodiment enables the highest gamma voltage at the zeroth gamma output tab to match the lowest gray scale data signal. The present embodiment also enables the gradually decreasing gamma voltages at the first through $255^{th}$ gamma output tabs to match the gray scale data signals being gradually increased in the sequence progressing from the first gamma output tab to the $255^{th}$ gamma output tab. In other words, a higher gamma voltage at a lower order gamma output tab is used to generate a lower gray scale data signal for realizing black brightness, and a lower gamma voltage at a higher order gamma output tab is used to generate a higher gray scale data signal for realizing white brightness.

As shown in FIG. 6, the highest input voltage VR0 is applied to the zeroth gamma input tab IP_0. The highest gamma voltage GM_R0 is output at the zeroth gamma output tab OP_0. The highest voltage gamma voltage GM_R0 is used as a zero gray scale data signal with the highest voltage level. The lowest reference voltage VR0 is applied to the ninth gamma tab so that the lowest gamma voltage GM_R255 is generated at the $255^{th}$ gamma output tab. The lowest voltage gamma voltage GM R255 is used as a 255 gray scale data signal with the lowest voltage level.

The gamma voltage sets R_GV generated by the gamma voltage generator 106 are applied to the data driver 103. The data driver 103 also receives R, G and B data RGB_D that is indicative of gray scale level setting (e.g. 0 to 255) for each of the colors in each pixel P. Gray scale level "0" represents a black level output, and gray scale level "255" represents a white level output.

Generally speaking, the data driver 103 uses the R, G and B data RGB_D to select a gamma voltage GM_R from the gamma voltage sets R_GV. For a given color and a given pixel, the gamma voltage GM_R selected by the data driver 103 increases as the value of the R, G and B data RGB_D decreases (i.e. as the gray scale level decreases). Similarly, the gamma voltage GM_R selected by the data driver 103 decreases as the value of the the R, G and B data RGB_D increases (i.e. as the gray scale level increases).

Stated differently, although the gamma voltages GM_R gradually decrease from the zeroth gamma output tab GM_R0 to the $255^{th}$ gamma output tab GM_R255, the data driver 103 reversely matches the decreasing gamma voltages GM_R to the rising gray scale data signals RGB_D. Thus, gamma voltages GM_R having lower voltage levels (e.g. GM_R255) are matched to higher gray scale levels (e.g. gray scale 255) and gamma voltages GM_R having higher voltage levels (e.g., GM_R0 are matched to lower gray scale levels (e.g. gray scale 0).

As shown in FIG. 6, the data driver 103 can include a data converter 121, a latch portion 122, a D-A converter 123 and a data output portion 124 serially connected to one another. The data converter 121 converts the R, G and B data RGB_D from the timing controller 105 into bit_converted R, G and B data which each have eight bits (e.g. serial to parallel conversion). The bit-converted R, G and B data is latched in a latch portion 122.

The D-A converter 123 converts the bit-converted R, G and B data into analog R, G and B data signals in such a manner as to select one of the gamma voltage GM_R corresponding with the logical gray scale value of the bit-converted data. In other words, the D-A converter 123 selects one of the gamma voltages GM_R from an output tab OP that corresponds with the logical gray scale value of the bit-converted data. For example, the D-A converter may use logical gray scale value 0 to select gamma voltage GM_R0. Logical gray scale value 1 is used to select gamma voltage GM_R1. Logical gray scale value 2 is used to select gamma voltage GM_R2. This sequence continues for every logical gray scale value between 0 and 255. The converted analog R, G and B data signals are then applied to the display panel 101 through the data output portion 124.

Additionally, referring again to the gamma voltage generator 106, the zeroth input gamma tab IP_0 is physically separated from the resistor string 602, first through ninth input gamma tabs IP_1-IP_9, and most of the output gamma tabs GM_R1-GM_R255. In other words, input tab IP_0 is electrically isolated from the resistor string 602, first through ninth input gamma tabs IP_1-IP_9, and output gamma tabs OP_1-OP_255. The electrical isolation prevents the zeroth input voltage VR0 from having any significant effect on the level of gamma voltages GM_R1 through GM_R255. The zeroth input voltage VR0 is only used in generating the zeroth gamma voltage GM_R0. As a result, the zeroth gamma voltage GM_R0 can be driven to a black level voltage without having a detrimental influence on the voltage levels of the remaining gamma voltages GM_R1-GM_R255, which in turn prevents the deterioration of brightness in a low gray scale domain.

The data driver 103 disclosed herein uses a high voltage gamma voltage output from a lower-ordered gamma output tab to match low gray scale data. This high voltage is used to realize black level brightness. Also, the data driver 103 uses a low gamma voltage output from a higher-ordered gamma output tab to match high gray scale data, which is output from the latch portion 122. This low voltage is used to realize white level brightness. Therefore, the deterioration of brightness can be prevented. The detailed driving method for this will be described referring to FIGS. 7 and 8.

Figure 7:
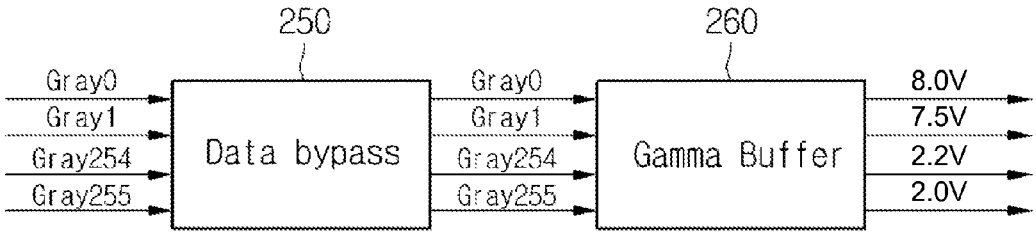
FIG. 7 is a block diagram illustrating a driving system of the OLED panel according to an embodiment of the present disclosure.
Figure 8:
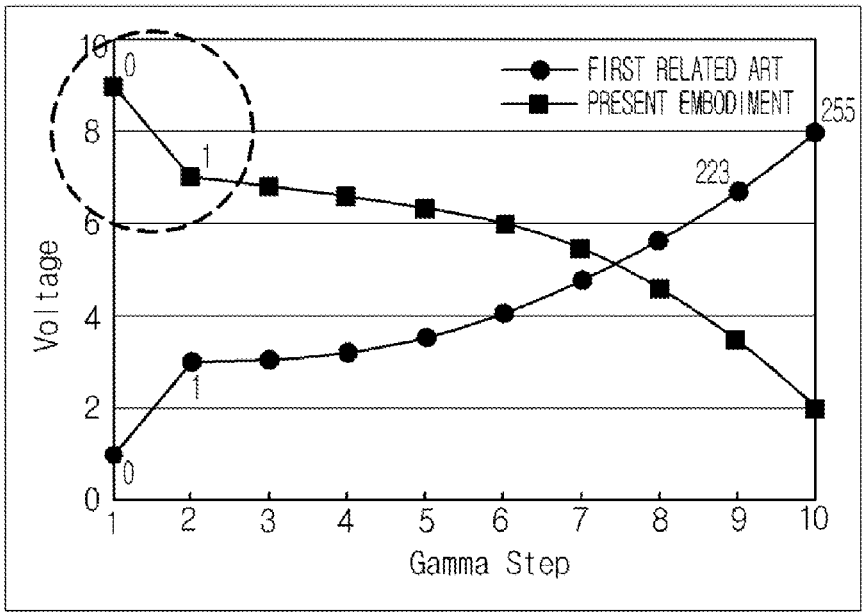
FIG. 8 is a data sheet comparing gamma voltages of the gamma voltage generators included in the conventional OLED devices and the embodiment of the present disclosure.

FIG. 7 is a block diagram illustrating a driving system of the OLED panel according to an embodiment of the present disclosure. FIG. 8 is a data sheet comparing gamma voltages of the gamma voltage generators included in the OLED devices according to the related art and the embodiment of the present disclosure.

Referring to FIG. 7, shown is a data bypass circuit 250 and a gamma buffer 260. In one embodiment, data bypass circuit 250 is in the timing controller 105 and gamma buffer 260 is the data driver 103.

Data bypass portion 250 allows the zero through 255 gray scale data to originally pass through it. A gamma buffer 260 allows the highest gamma voltage being output from the zeroth gamma output tab to be opposite the zero gray scale data. Also, the gamma buffer 260 reversely allots the first through $255^{th}$ gamma voltages, which are gradually lowered according to the sequence progressing from first gamma output tab to the $255^{th}$ gamma output tab, to the 1 through 255 gray scale data which their logical values are gradually raised, unlike that of the related art, as described in FIG. 6. In other words, the gamma buffer 260 enables not only the highest gamma voltage generated at the zeroth gamma output tab to be opposite the lowest data with the lowest gray scale, but also the lowest gamma voltage generated at the $255^{th}$ gamma output tab to be opposite the highest data with 255 gray scale. Consequently, a data signal used for realizing black brightness has a higher voltage compared to another data signal used for realizing white brightness.

Such data bypass portion 250 and gamma buffer 260 can be formed in a single body united with either, a gamma integrated circuit implementing the gamma voltage generator 106, or the data driver 103. Also, although the gamma voltage generator 106 is shown in the drawings in such a manner as to be separated from the data driver 105, it can be formed in a gamma integrated circuit included in the data driver 103.

As shown in FIG. 8, the present embodiment enables not only the highest gamma voltage to be output through the zeroth gamma output tab, but also the data signal corresponding to the lowest gray scale data to be derived from the highest gamma voltage, unlike the related art. As such, black brightness can be realized by the highest gamma voltage.

Figure 11:
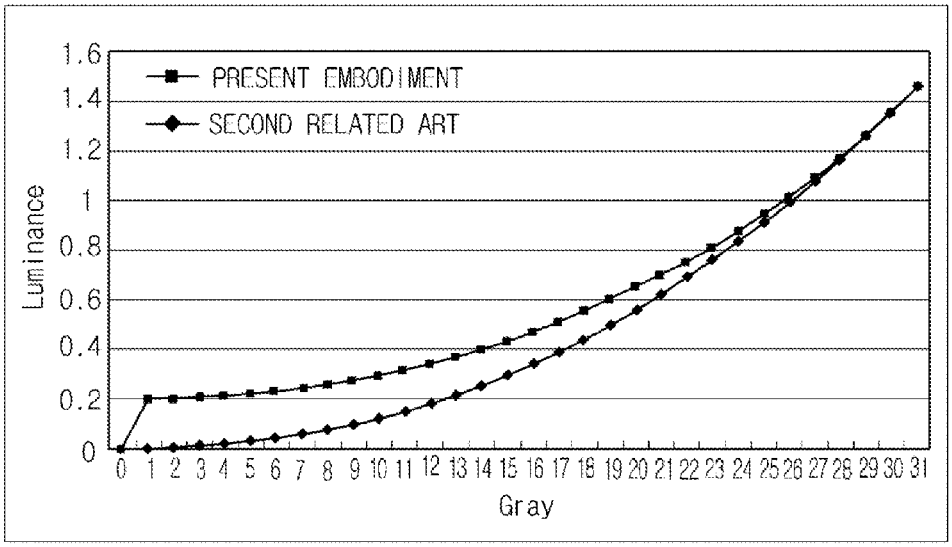
FIG. 11 is a data sheet illustrating an enhanced brightness characteristic of the low gray scales in the OLED device according to the embodiment of the present disclosure, compared to that in one according to the related art.

Also, the present embodiment separates the zeroth and first gamma output tabs, which output the highest gamma voltages, from each other. As such, a current flowing between the zeroth and first gamma output tabs according the present embodiment is less compared to the related art. The present embodiment provides a gamma characteristic similar to a gamma curve of 2.2 in the related art, as shown in FIG. 11. However, the present embodiment enables the data signal with 0 gray scale to be opposite the highest gamma voltage and brightness of about 0.2 nit to be realized in one gray scale. In accordance therewith, the deterioration of brightness in a low gray scale domain can be prevented.

Figures 9, 10:
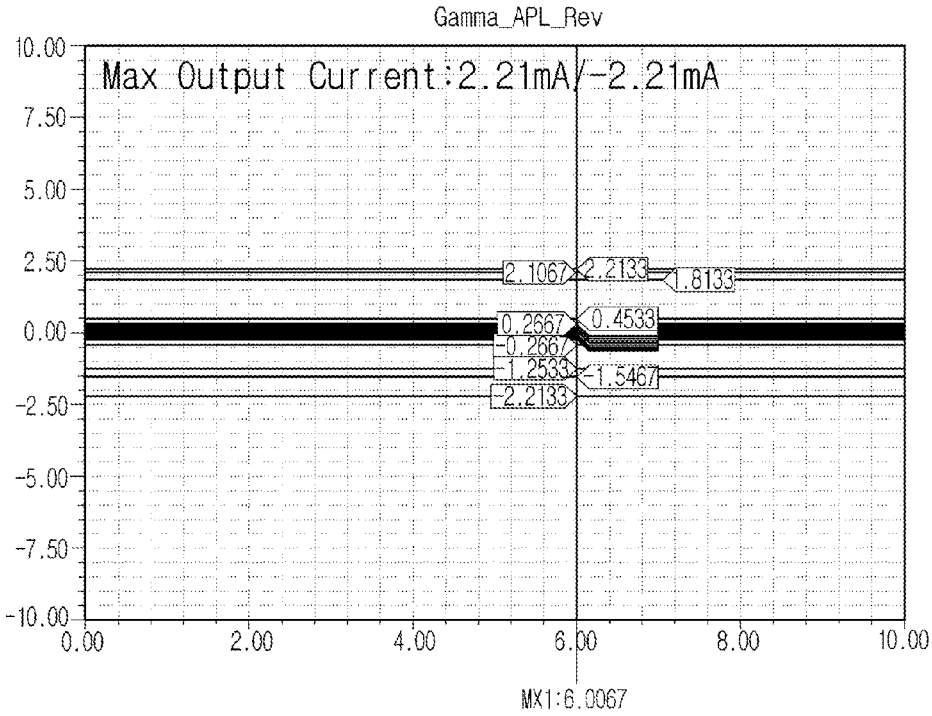
FIG. 9 is a data sheet illustrating a current characteristic of the gamma voltage generator of the OLED device according to the embodiment of the present disclosure.
FIG. 10 is a table comparing the heat generation characteristic of the gamma voltage generator of the OLED device according to the embodiment of the present disclosure.

FIG. 9 is a data sheet illustrating a current characteristic of the gamma voltage generator of the OLED device according to the embodiment of the present disclosure. FIG. 10 is a table comparing a heat generation characteristic of the gamma voltage generator of the OLED device according to the embodiment of the present disclosure.

As shown in FIGS. 9 and 10, the present embodiment realizes black brightness using the highest gamma voltage, but includes the zeroth and first gamma tabs spaced from each other and the zeroth and first gamma output tabs spaced from each other. Therefore, although the highest gamma voltages are generated at the zeroth and first gamma output tabs, there is little current flowing between the zeroth and first gamma tabs or between the zeroth and first gamma output tabs.

As seen from the drawings, it is evident that the current outputs of the zeroth and first gamma output tabs, which are used for realizing black brightness in the present embodiment, have lower current outputs of about 2.21 mA and −2.21 mA compared to those of about 6.19 mA and −64.32 mA in the related art.

In this manner, since the currents flowing the zeroth and first gamma output tabs within the gamma voltage generator 106 decrease, the present embodiment generates only heat capable of heating the OLED device to about 62.9~71.6° C., unlike the related art generating heat capable of heating the OLED device to about 83.3~92.0° C.

In other words, the quantity of heat generated in a gamma integrated circuit, which forms the gamma voltage generator 106 of the present embodiment, can be reduced 20 percent or more, compared to that generated in the related art. As such, power consumption can be reduced and components of the OLED device can be protected.

FIG. 11 is a data sheet illustrating an enhanced brightness characteristic of the low gray scales in the OLED device according to the embodiment of the present disclosure, compared to that in one according to the related art.

As shown in the drawing, the present embodiment enables brightness characteristic for the gray scales of 0 and 1 to be varied in a non-linear shape similar to a gamma curve of 2.2 according to the related art. Therefore, the present embodiment can provide a substantial black brightness characteristic, and prevent the deterioration of brightness in a low gray scale domain including the gray scales of 1~31.

In other words, since the zeroth and first gamma output tabs outputting the highest gamma voltages are separated from each other, not only black brightness can be realized in the gray scale of "0", but also brightness of 0.2 nit can be obtained in the gray scale of "1"

In accordance therewith, desired black brightness can be completely realized at the gray scale of "0", and furthermore visible brightness can be provided in the low gray scale domain including the gray scales 1~31. As such, contrast in the low gray scale domain can be enhanced.

On the other hand, the second related art causes the deterioration of brightness in the low gray scale domain. This results from the fact that the zeroth and ninth gamma tabs receives the lowest and highest reference voltages, respectively, and the ninth and eighth gamma tabs are connected to each other through a resistor without being separated from each other.

Figure 12:
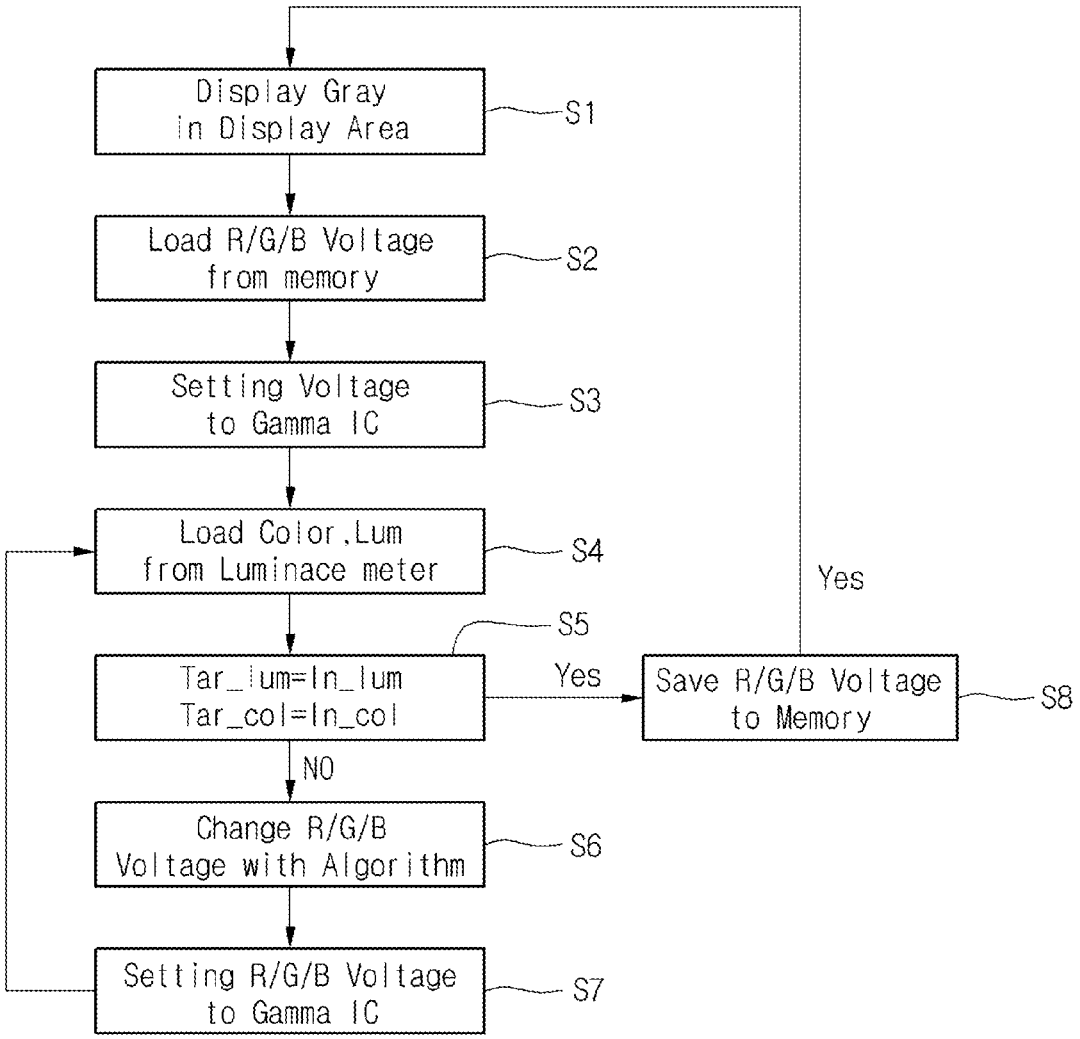
FIG. 12 is a flow chart illustrating a process of setting gamma voltages which are used for driving an OLED panel with reversed data voltages according to an embodiment of the present disclosure.

FIG. 12 is a flow chart illustrating a process of setting gamma voltages which are used for driving an OLED panel with reversed data voltages according to an embodiment of the present disclosure.

As shown in FIG. 12, a pattern of a specific gray scale to be set is displayed on the display panel 101 (Step S1), and the R, G and B data voltages stored in a memory within the gamma voltage generator 105 or the data driver 103 are loaded (S2).

Thereafter, the loaded R, G and B data voltages are set in the gamma voltage generator 106 (S3). Then, chromaticity and brightness for an image displayed on the display panel are read from a brightness meter and are loaded (S4).

The loaded chromaticity and brightness are compared with target brightness and target chromaticity for the specific gray scale using a look-up table stored in the memory (S5).

If the loaded brightness and chromaticity are different from the target brightness and the target chromaticity for each gray scale, the R, G and B data voltages are altered according to a fixed algorithm stored in the memory (S6). In other words, the R, G and B data voltages are extracted through the comparison of brightness and chromaticity for each gray scale.

In this way, when the data voltage for the specific gray scale image is set, the R, G and B data voltages for another gray scale image are set in the same manner as described above (S7).

On the other hand, when the loaded brightness and chromaticity are the same as the target brightness and the target chromaticity for the specific gray scale, the R, G and B data voltages for the specific gray scale is stored in the memory (S8). Subsequently, the above-mentioned steps of S1 through S8 will be repeatedly performed in order to set the data voltages for other gray scale images.

The present embodiment outputs the highest gamma voltage through the gamma output tab which had been output the lowest gamma voltage in the related art, and enables the highest gamma voltage to be opposite the low gray scale data signal in the same manner as the related art. As such, the present embodiment can prevent the deterioration of brightness in a low gray scale domain.

Also, as described above, the present embodiment previously sets the data voltage opposite to the gamma voltage which is generated in the gamma voltage generator. As such, the OLED device can be driven by the data voltage which is derived from the gamma voltage opposite to the gray scale value of the data signal.

Moreover, the present embodiment reversely applies the power supply voltage to the serially arranged gamma tabs within the gamma voltage generator, and sets the voltage of the data signal in proportion to the gamma voltage which is output from the gamma voltage generator. Therefore, the deterioration of brightness can be prevented.

Furthermore, the present embodiment reversely applies the reference voltages to the serially arranged gamma tabs within the gamma voltage generator, and sets the voltage of the data signal in proportion to the gamma voltage which is output from the gamma voltage generator. In accordance therewith, the heat generation characteristic of an integrated circuit which forms the gamma voltage generator can be enhanced.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. A display device comprising:

a gamma voltage generator configured to receive ten sequentially decreasing reference voltages and to generate 256 sequentially decreasing gamma voltages based on the sequentially decreasing reference voltages, wherein the gamma voltage generator comprises:

a resistor string to generate at least some of the gamma voltages based on at least some of the reference voltages;

a zeroth input tab to receive a highest reference voltage of the reference voltages, wherein a highest gamma voltage of the gamma voltages is generated from the highest reference voltage, the highest reference voltage corresponding to a pixel brightness of 0 nit and the zeroth input tab being electrically isolated from the resistor string; and a first input tab coupled to the resistor string and to receive a second highest reference voltage of the reference voltages, wherein a second highest gamma voltage of the gamma voltages is generated from the second highest reference voltage, the second highest reference voltage corresponding to a pixel brightness of 0.2 nit; and a data driver coupled to the gamma voltage generator and configured to:

receive the sequentially decreasing gamma voltages from the gamma voltage generator, output, to a pixel, a first gamma voltage selected from the gamma voltages responsive to receiving first digital data indicative of a first gray scale level of the pixel, and output, to the pixel, a second gamma voltage from the gamma voltages responsive to receiving second digital data having a higher logical value than the first digital data and indicative of a second gray scale level higher than the first gray scale level, wherein the second gamma voltage is lower than the first gamma voltage.

2. The display device of claim 1, wherein the first and second digital data are indicative of the first and second gray scale levels for one of the following pixel colors: red, green, or blue.

3. A method of operation in a display device, comprising:

generating 256 sequentially decreasing gamma voltages based on ten sequentially decreasing reference voltages, wherein generating the sequentially decreasing gamma voltages comprises;

generating, with a resistor string of a gamma voltage generator, at least some of the gamma voltages based on at least some of the reference voltages;

receiving, at a zeroth input tab of the gamma voltage generator, a highest reference voltage of the reference voltages, the highest reference voltage corresponding to a pixel brightness of 0 nit and the zeroth input tab being electrically isolated from the resistor string;

generating a highest gamma voltage of the gamma voltages from the highest reference voltage;

receiving, at a first input tab coupled to the resistor string, a second highest reference voltage of the reference voltages, the second highest reference voltage corresponding to a pixel brightness of 0.2 nit; and generating a second highest gamma voltage of the gamma voltages from the second highest reference voltage; and receiving, at a data driver, the sequentially decreasing gamma voltages;

outputting, to a pixel, a first gamma voltage selected from the gamma voltages responsive to the data driver receiving first digital data indicative of a first gray scale level of the pixel; and outputting, to the pixel, a second gamma voltage from the gamma voltages responsive to the data driver receiving second digital data having a higher logical value than the first digital data and indicative of a second gray scale level higher than the first gray scale level, wherein the second gamma voltage is lower than the first gamma voltage.

4. The method of claim 3, wherein the first and second digital data are indicative of the first and second gray scale levels for one of the following pixel colors: red, green, or blue.

* * * * *